US009876314B1

(12) United States Patent
Cai

(10) Patent No.: US 9,876,314 B1
(45) Date of Patent: Jan. 23, 2018

(54) CARD EDGE CONNECTOR

(71) Applicant: LOTES CO., LTD, Keelung (TW)

(72) Inventor: You Hua Cai, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/622,540

(22) Filed: Jun. 14, 2017

Related U.S. Application Data

(60) Provisional application No. 62/361,720, filed on Jul. 13, 2016.

(51) Int. Cl.

| | |
|---|---|
| ***H01R 13/62*** | (2006.01) |
| ***H01R 13/629*** | (2006.01) |
| ***H01R 12/72*** | (2011.01) |
| *H01R 12/70* | (2011.01) |

(52) U.S. Cl.
CPC ..... *H01R 13/62938* (2013.01); *H01R 12/721* (2013.01); *H01R 12/7005* (2013.01)

(58) Field of Classification Search
None
See application file for complete search history.

(56) References Cited

U.S. PATENT DOCUMENTS 5,660,552 A * 8/1997 Suzuki ..... H05K 7/1409 439/157
7,866,995 B1 * 1/2011 Kudo ..... H01R 12/721 439/157

* cited by examiner

*Primary Examiner* — Tho D Ta
(74) *Attorney, Agent, or Firm* — Locke Lord LLP; Tim Tingkang Xia, Esq.

(57) ABSTRACT

A card edge connector includes an insulating body with a central slot extending along a longitudinal direction and for inserting an electronic card, conductive terminals arranged on the insulating body, and at least one latch device arranged at one end of the insulating body and having a rotating member pivoted to the insulating body and a pressing member pressing the rotating member and moving vertically relative to the insulating body. Each conductive terminal has a contact portion protruding into the central slot. The rotating member has a latch portion latching the electronic card and a card ejecting portion abutting against and pushing the electronic card. One of the rotating and pressing members has first and second crimping chamfers, and the other slides on the first crimping chamfer before sliding on the second crimping chamfer to form two-stage sliding during which pressing force required for the pressing member's downward movement changes.

22 Claims, 16 Drawing Sheets

A-A

CARD EDGE CONNECTOR

CROSS-REFERENCE TO RELATED APPLICATION

This application claims priority and the benefit of U.S. Provisional Application No. 62/361,720, filed on Jul. 13, 2016, the entire contents of which are hereby incorporated by reference.

FIELD OF THE INVENTION

The present invention relates to a card edge connector, and more particularly to a card edge connector which implements card withdrawal in a pressing manner.

BACKGROUND OF THE INVENTION

A known card edge connector includes an insulating body, multiple conductive terminals arranged on the insulating body and two latch devices arranged at the two ends of the insulating body. The insulating body is provided with a central slot extending along a longitudinal direction, and each conductive terminal is provided with a contact portion which protrudes and extends into the central slot and contacts with an electronic card to form electrical connection. A mounting portion is arranged at each of the two ends of the central slot of the insulating body, the latch devices are mounted in the mounting portions, each latch device is provided with a rotating member and a pressing member, and a latch portion used to latch the electronic card and a card ejecting portion used to withdraw the electronic card are arranged at the upper and lower ends of the rotating member, where the rotating member is pivoted with the corresponding mounting portion, so that the rotating member can rotate relative to the insulating body in the longitudinal direction through a rotating axis, and the bottom of the pressing member abuts against the top of the rotating member. When a user presses the pressing members downwards, the bottoms of the pressing members apply force to the tops of the rotating members to cause the rotating members to rotate outwards, and in an outward rotating process of the rotating members, distances between action points of the rotating members and the pressing members and the rotating axes are almost kept unchanged on a vertical plane.

According to the foregoing structure, in a process of upward exerting force on and pushing the electronic card to be withdrawn from the central slot by the card ejecting portions, the rotating members are required to rotate a large angle outwards, so that the overall length of the card edge connector is relatively large when the rotating members are in an open state; in addition, force required to press the pressing members downwards by the user is relatively strong; and moreover, in an impact test of the card edge connector, there is no limiting structure arranged for outward rotation of the rotating members when the card edge connector is inverted, so that the electronic card is easily separated from the central slot.

Therefore, it is necessary to design a card edge connector, so as to overcome the foregoing problem.

SUMMARY OF THE INVENTION

In view of the above problems in the related art, the present invention is directed to a card edge connector which is compact in overall structure and relatively labor-saving in a pressing process and can prevent card dropping in an impact test.

To achieve the foregoing objective, the present invention adopts the following technical solution.

In one aspect, a card edge connector electrically connecting an electronic card includes an insulating body, provided with a central slot which extends along a longitudinal direction and is used to insert the electronic card, multiple conductive terminals, arranged on the insulating body, where each conductive terminal is provided with a contact portion protruding and extending into the central slot and used to be electrically connected with the electronic card, and at least one latch device, arranged at one end of the insulating body, where the latch device includes a rotating member and a pressing member used to press the rotating member, the rotating member is pivoted to the insulating body, the pressing member moves vertically relative to the insulating body, the rotating member is provided with a latch portion used to latch the electronic card and a card ejecting portion used to abut against and push the electronic card, one of the rotating member and the pressing member is provided with a first crimping chamfer and a second crimping chamfer, and sliding of the other one of the rotating member and the pressing member on the first crimping chamfer is before sliding on the second crimping chamfer.

In certain embodiments, the other one of the rotating member and the pressing member has a first actuating portion and a second actuating portion, and the first actuating portion slides on the first crimping chamfer before the second actuating portion slides on the second crimping chamfer.

In certain embodiments, the first crimping chamfer and the second chamfer are disposed with an interval therebetween, one of the rotating member and the pressing member is also provided with a third crimping chamfer connected with the first crimping chamfer end to end, and when the first actuating portion slides on and along the third crimping chamfer, the second actuating portion slides on and along the second crimping chamfer correspondingly.

In certain embodiments, an angle between the third crimping chamfer and the longitudinal direction is greater than an angle between the first crimping chamfer and the longitudinal direction.

In certain embodiments, the first crimping chamfer and the second crimping chamfer are arranged on the rotating member, a slot is formed by being upwardly sunken into the bottom edge of the pressing member, the slot penetrates through the pressing member in the longitudinal direction, the first actuating portion is formed on the two opposite sides of the slot in the bottom edge of the pressing member respectively, the two opposite sides of the slot extend toward the bottom edge of the pressing member respectively to form a plurality of extending portions, and the second actuating portion is formed at each of ends of the extending portions.

In certain embodiments, the rotating member rotates relative to the insulating body around an axis of a rotating shaft, and action points of the other one of the rotating member and the pressing member on the first crimping chamfer and on the second crimping chamfer are consistently located further away from the central slot along the longitudinal direction than the axis is.

In certain embodiments, at least one end of the insulating body is provided with a mounting portion, which has a receiving groove, two lateral walls positioned on the two opposite sides of the receiving groove, and at least one end wall, the end wall is provided with a through slot communicated with the receiving groove and a connecting portion positioned above the through slot and connected to the two lateral walls, the through slot penetrates through the end wall along the longitudinal direction, the rotating member is at least partially exposed to the insulating body through the through slot when the card ejecting portion completely abuts against and pushes the electronic card, and the rotating member is completely hidden in the mounting portion when the latch portion latches the electronic card.

In certain embodiments, the end wall has two side portions positioned on the two sides of the through slot, the connecting portion is connected to the upper ends of the two side portions, and the rotating member has a protrusion buckled to the side portions.

In another aspect, a card edge connector used to electrically connect an electronic card includes an insulating body provided with a central slot extending along a longitudinal direction and used to insert the electronic card, multiple conductive terminals arranged on the insulating body, where each conductive terminal is provided with a contact portion protruding and extending into the central slot and used to be electrically connected with the electronic card, and at least one latch device arranged at one end of the insulating body, where the latch device includes a rotating member and a pressing member used to press the rotating member downwards, the rotating member is pivoted to the insulating body, the pressing member moves vertically relative to the insulating body, the rotating member is provided with a card ejecting portion and a latch portion, one of the rotating member and the pressing member is provided with a crimping chamfer and a limiting portion, the other one is provided with an actuating portion and a flange, the actuating portion slides along the crimping chamfer to cause the rotating member to rotate and cause the card ejecting portion to abut against and push the electronic card when the pressing member presses the rotating member, and the flange is limited by the limiting portion to avoid the latch portion from being separated from the electronic card when the latch portion latches the electronic card.

In certain embodiments, the at least one crimping chamfer includes a first crimping chamfer and a second crimping chamfer, which are disposed with an interval therebetween, the limiting portion is positioned between the first crimping chamfer and the second crimping chamfer, the pressing member presses the rotating member to cause the flange to slide between the first crimping chamfer and the limiting portion, and sliding of the actuating portion on the first crimping chamfer is before sliding of the actuating portion on the second crimping chamfer.

In certain embodiments, the at least one crimping chamfer further includes a third crimping chamfer connected with the first crimping chamfer end to end, and an angle between the third crimping chamfer and the longitudinal direction is greater than an angle between the first crimping chamfer and the longitudinal direction.

In certain embodiments, the at least one actuating portion includes a first actuating portion and a second actuating portion, and first actuating portion slides on the first crimping chamfer before the second actuating portion slides on the second crimping chamfer.

In certain embodiments, the at least one crimping chamfer and the limiting portion are arranged on the rotating member, a slot is formed by being upwardly sunken into the bottom edge of the pressing member, the slot penetrates through the pressing member in the longitudinal direction, the at least one actuating portion is formed on each of the two opposite sides of the slot on the bottom edge of the pressing member, and the two opposite sides of the actuating portion protrude and extend toward each other to form the at least one flange.

In another aspect, a card edge connector used to electrically connect an electronic card includes an insulating body provided with a central slot extending along a longitudinal direction and used to insert the electronic card, multiple conductive terminals arranged on the insulating body, where each conductive terminal is provided with a contact portion protruding and extending into the central slot and used to be electrically connected with the electronic card, and at least one latch device arranged at one end of the insulating body, where the latch device includes a rotating member and a pressing member, the rotating member is pivoted to the insulating body, the pressing member moves vertically relative to the insulating body, the rotating member is provided with a card ejecting portion and a latch portion used to latch the electronic card, one of the rotating member and the pressing member is provided with a crimping chamfer, the other one is provided with an actuating portion, the pressing member presses the rotating member and the actuating portion slides along the crimping chamfer to cause the rotating member to rotate and cause the card ejecting portion to abut against and push the electronic card, and when the rotating member is in a latched state, an angle between the crimping chamfer and the longitudinal direction is 40°~75°.

In certain embodiments, the crimping chamfer includes a first crimping chamfer and a second crimping chamfer, which are disposed with an interval therebetween, the actuating portion is provided with a first actuating portion and a second actuating portion, which are matched with the first crimping chamfer and the second crimping chamfer respectively, and the first actuating portion slides on the first crimping chamfer before the second actuating portion slides on the second crimping chamfer.

In certain embodiments, the crimping chamfer also includes a third crimping chamfer, the third crimping chamfer is connected with the first crimping chamfer end to end, and when the first actuating portion slides on and along the third crimping chamfer, the second actuating portion slides on and along the second crimping chamfer correspondingly.

In certain embodiments, an angle between the third crimping chamfer and the longitudinal direction is greater than an angle between the first crimping chamfer and the longitudinal direction.

In certain embodiments, the first crimping chamfer and the second crimping chamfer are arranged on the rotating member, a slot is formed by being upwardly sunken into the bottom edge of the pressing member, the slot penetrates through the pressing member in the longitudinal direction, the first actuating portion is formed on each of two opposite sides of the slot on the bottom edge of the pressing member respectively, and the two opposite sides of the slot extend to the bottom edge of the pressing member to form a plurality of extending portions, and the second actuating portion is formed at each of ends of the extending portions respectively.

In certain embodiments, at least one end of the insulating body is provided with a mounting portion, the mounting portion is provided with a receiving groove, two lateral walls positioned on the two opposite sides of the receiving groove and at least one end wall, the end wall is provided with a through slot communicated with the receiving groove and a connecting portion positioned above the through slot and connected to the two lateral walls, the through slot penetrates through the end wall along the longitudinal direction, the rotating member is provided with a protrusion buckled to side portions, and when the card ejecting portion completely urges and pushes the electronic card, the rotating member is at least partially exposed to the insulating body through the through slot.

In certain embodiments, at least one end of the insulating body is provided with a mounting portion, the latch device is mounted on the mounting portion, a reinforcing rib protrudes and extends from each of the two sides of the mounting portion, and a clamping slot used to clamp the side edge of the electronic card is formed between the two reinforcing ribs.

In certain embodiments, the card edge connector further includes at least one power terminal, the electronic card is provided with a notch used for latching of the latch portion, the electronic card is provided with at least one power conductive sheet under the notch, and when the electronic card is inserted into the central slot, the power terminal is electrically connected with the power conductive sheet.

In certain embodiments, the card edge connector further includes at least a pair of power terminals and two side walls arranged at one end of the central slot, each power terminal is provided with a contact point, the rotating member is provided with a card ejecting portion, and no matter whether the rotating member is in an open or latched state, the card ejecting portion passes beyond the contact points without interference in the longitudinal direction.

Compared with the related art, the present invention has the advantages that sliding of the first actuating portion on the first crimping chamfer is before sliding of the second actuating portion on the second crimping chamfer, and in such a manner, the distances from the action points between the pressing member and the rotating member to the rotating axis between the rotating member and the insulating body are changed in two stages, so that maximum force required in a downward movement process of the pressing member is reduced; one of the rotating member and the pressing member is provided with the limiting portion, the other is provided with the flange matched with the limiting portion, and in an impact test of the card edge connector, the pressing member is limited by the insulating body, the pressing member and the insulating body are kept relative still, and the flange abuts against and presses the limiting portion to apply force toward the central slot to the rotating member to limit outward rotation of the rotating member and fasten the latch portion to the electronic card, so that the electronic card is prevented from being separated from the central slot in the impact test; the angle between the crimping chamfer and the longitudinal direction is 40°~75°, the pressing force required to be applied to the pressing member by a user gets weaker if an angle value of the angle gets more approximate to 90°, relatively large force is required to press the pressing member if the angle value of the angle is smaller than 40°, the pressing member is required to move downwards by a longer distance on the premise that the rotating member completely withdraws the electronic card if the angle value of the angle is more approximate to 90°, an outward rotating angle of the rotating member becomes greater, and considering the foregoing factors, the angle value of the angle ranges between 40°~75°, and in this angle range, each factor mentioned above can be balanced to enable the latch device to work in a better state.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

FIG. 4 is inverted.

DETAILED DESCRIPTION OF THE INVENTION

Figure 1:
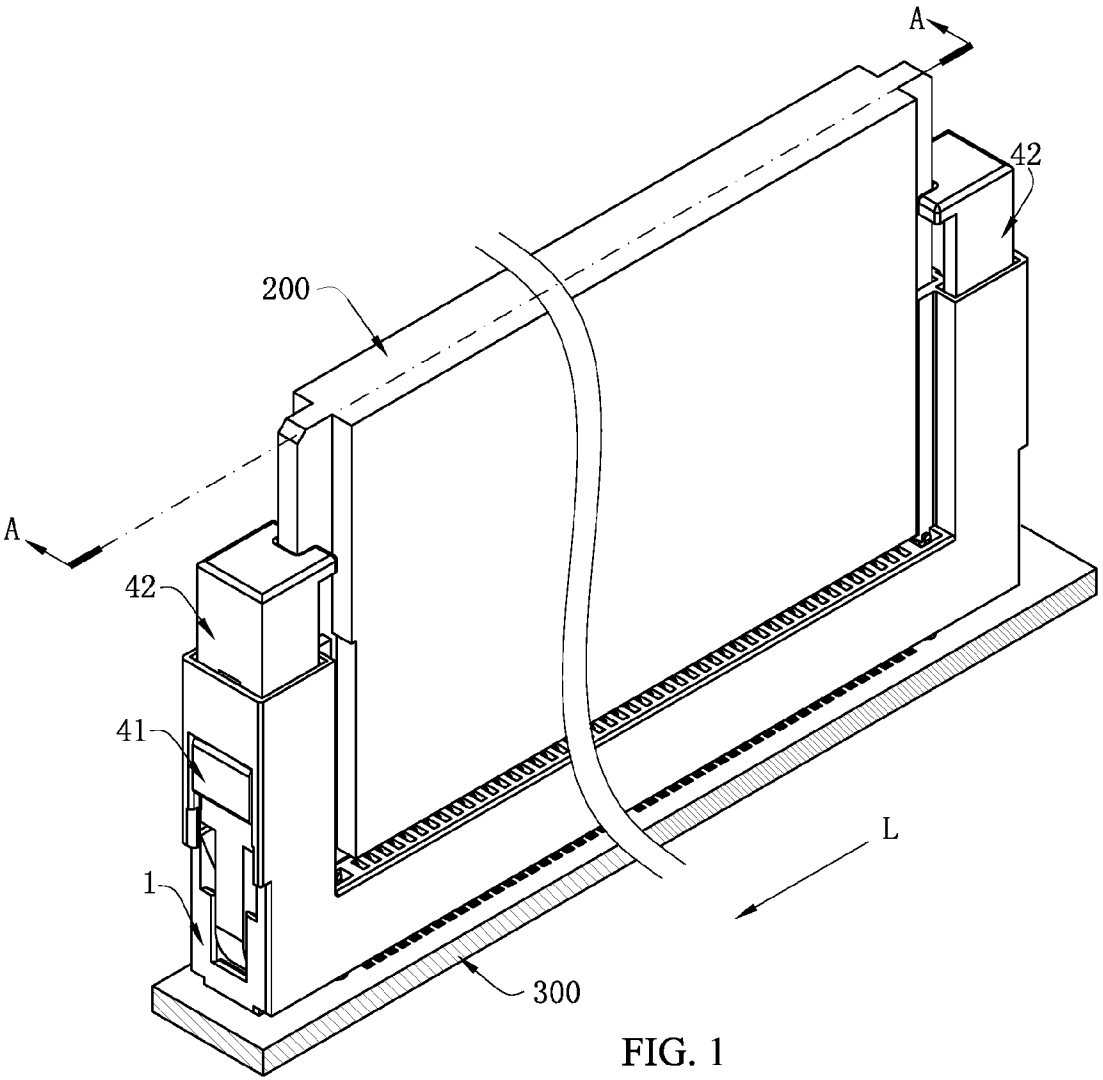
FIG. 1 is a three-dimensional assembled view of a card edge connector in a latched state, a circuit board and an electronic card according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-16. In accordance with the purposes of this invention, as embodied and broadly described herein, this invention, in one aspect, relates to a card edge connector.

Figure 2:
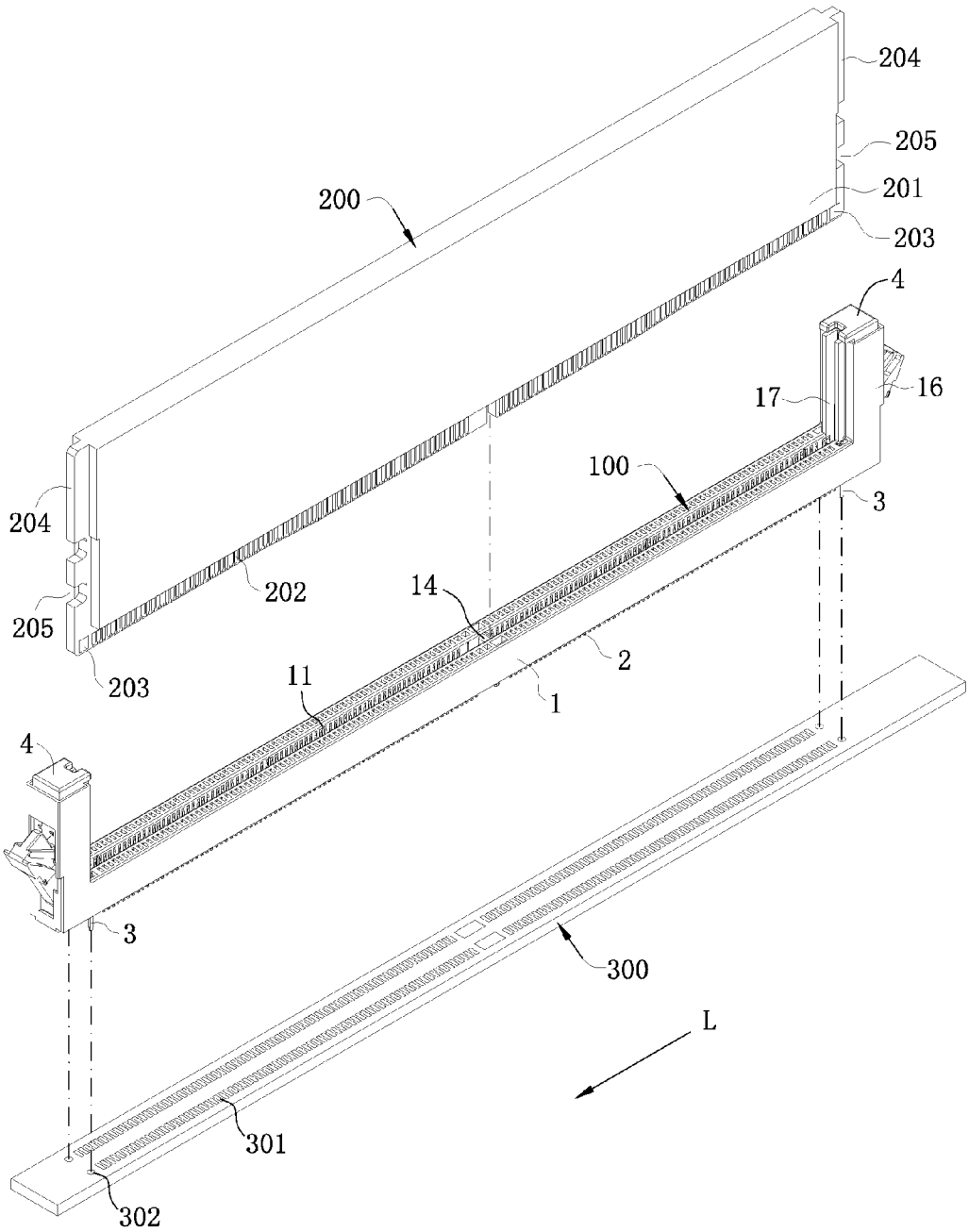
FIG. 2 is a three-dimensional exploded view of a card edge connector, a circuit board and an electronic card according to the first embodiment of the present invention.
Figure 3:
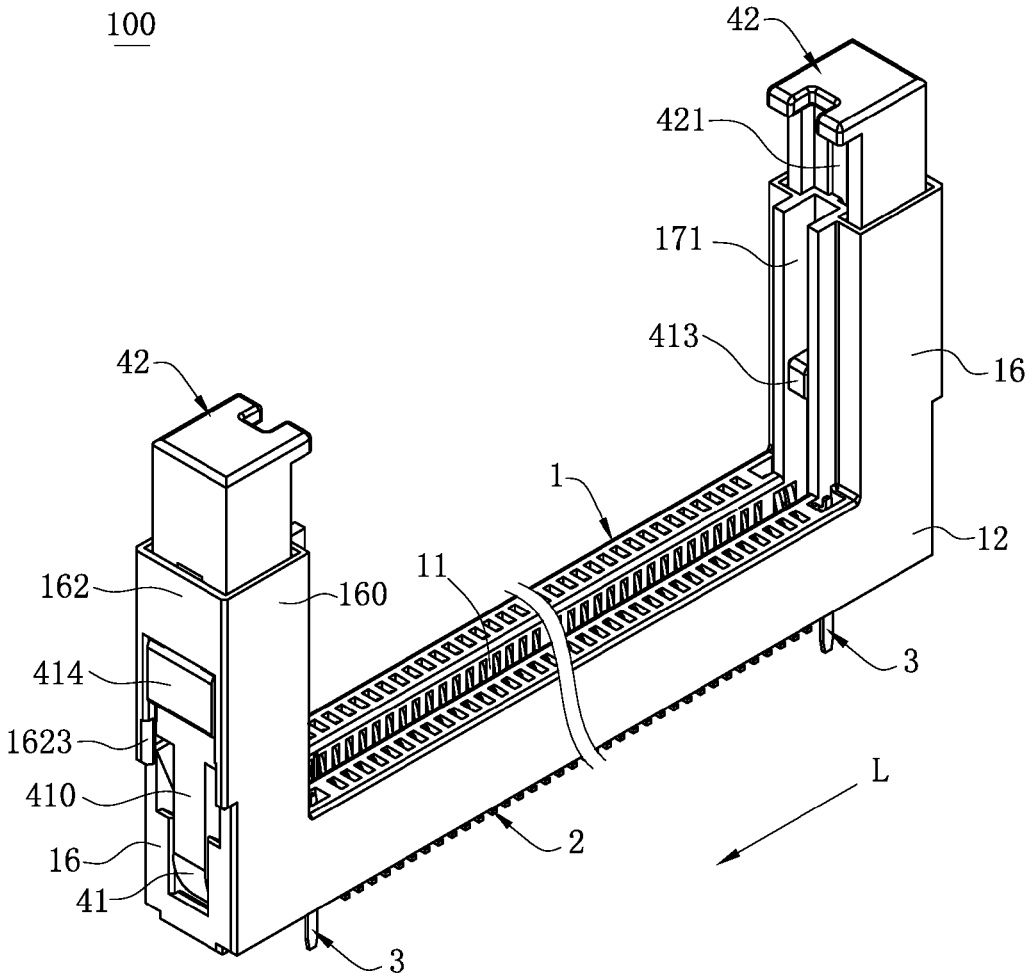
FIG. 3 is a three-dimensional assembled view of a card edge connector in FIG. 1.

Referring to FIG. 1, FIG. 2 and FIG. 3, a card edge connector 100 of a first embodiment of the present invention is shown, and is configured to electrically connect an electronic card 200 and a circuit board 300, where the card edge connector 100 includes an insulating body 1, multiple conductive terminals 2, multiple power terminals 3 and two latch devices 4.

Referring to FIG. 2, the electronic card 200 is provided with an insertion end 201, and multiple first conductive sheets 202 are arranged on both surfaces of the insertion end 201. Two power conductive sheets 203 are arranged on each surface of the electronic card 200, and the multiple first conductive sheets 202 of each surface are positioned between the two power conductive sheets 203. The electronic card 200 is provided with two side edges 204, each side edge 204 is provided with at least one notch 205, and the power conductive sheets 203 are positioned under the notches 205. The circuit board 300 is provided with multiple conductive spacers 301, the multiple conductive spacers 301 are arranged in two rows, and two jacks 302 are formed in each of the two ends of each of the multiple conductive spacers 301.

Figure 4:
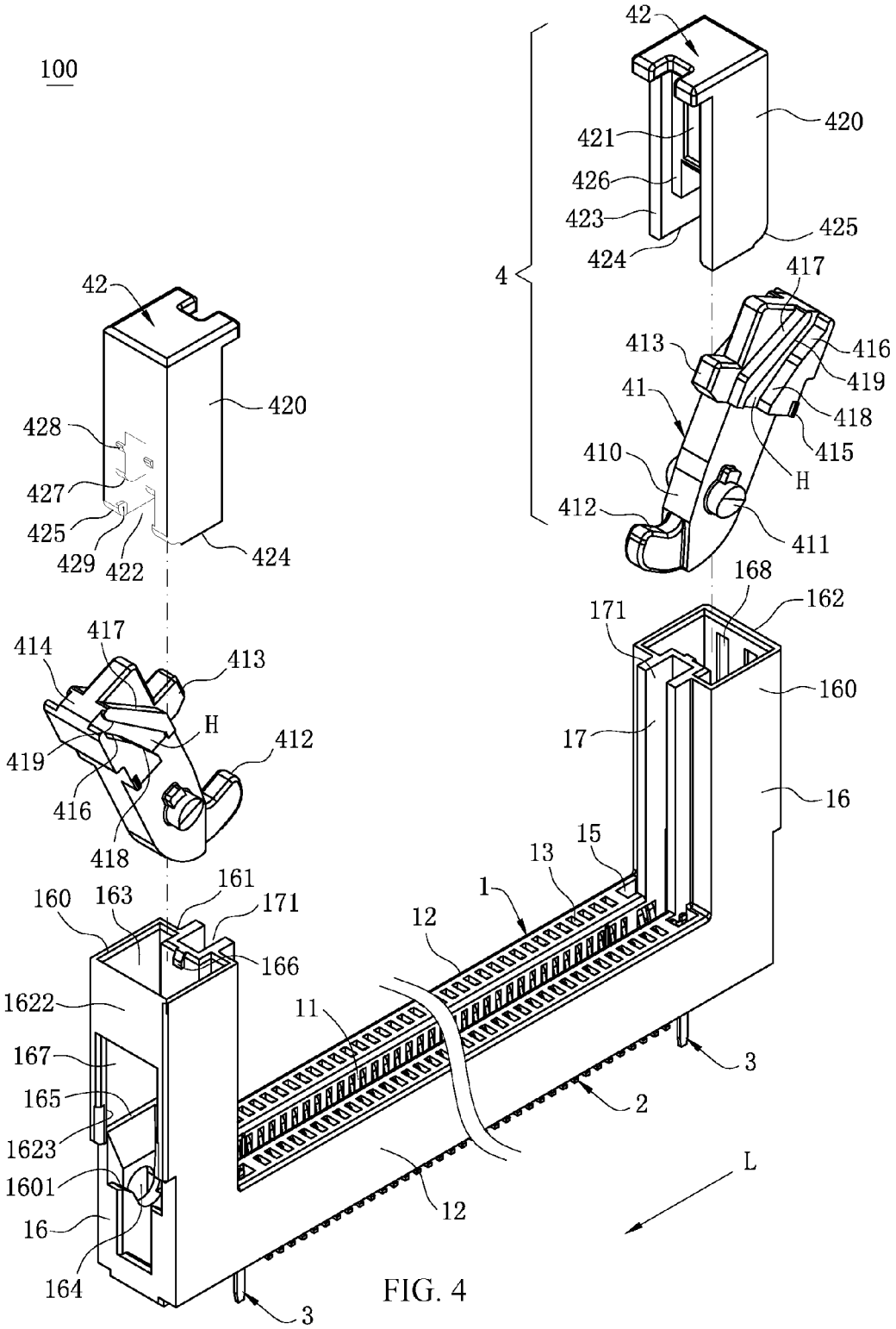
FIG. 4 is a three-dimensional exploded view of FIG. 3.

Referring to FIG. 2, FIG. 3 and FIG. 4, the insulating body 1 is provided with a central slot 11 which extends along a longitudinal direction L and is configured to insert the electronic card 200, and the central slot 11 is formed by downward sinking from the upper surface of the insulating body 1. The insulating body 1 is provided with two side walls 12 positioned on the two sides of the slot 11, multiple terminal housings 13 are arranged on each side wall 12, and the terminal housings 13 are communicated with the central slot 11. The insulating body 1 is provided with a fool-proof portion 14 upwards protruding and extending from the slot bottom of the central slot 11, and multiple terminal housings 13 are arranged at both ends of the fool-proof portion 14. A power terminal hole 15 is formed in each of the two ends of each side wall 12, the power terminal hole 15 is communicated with the central slot 11, and the two power terminal holes 15 at the same end of the central slot 11 are oppositely formed.

Figure 6:
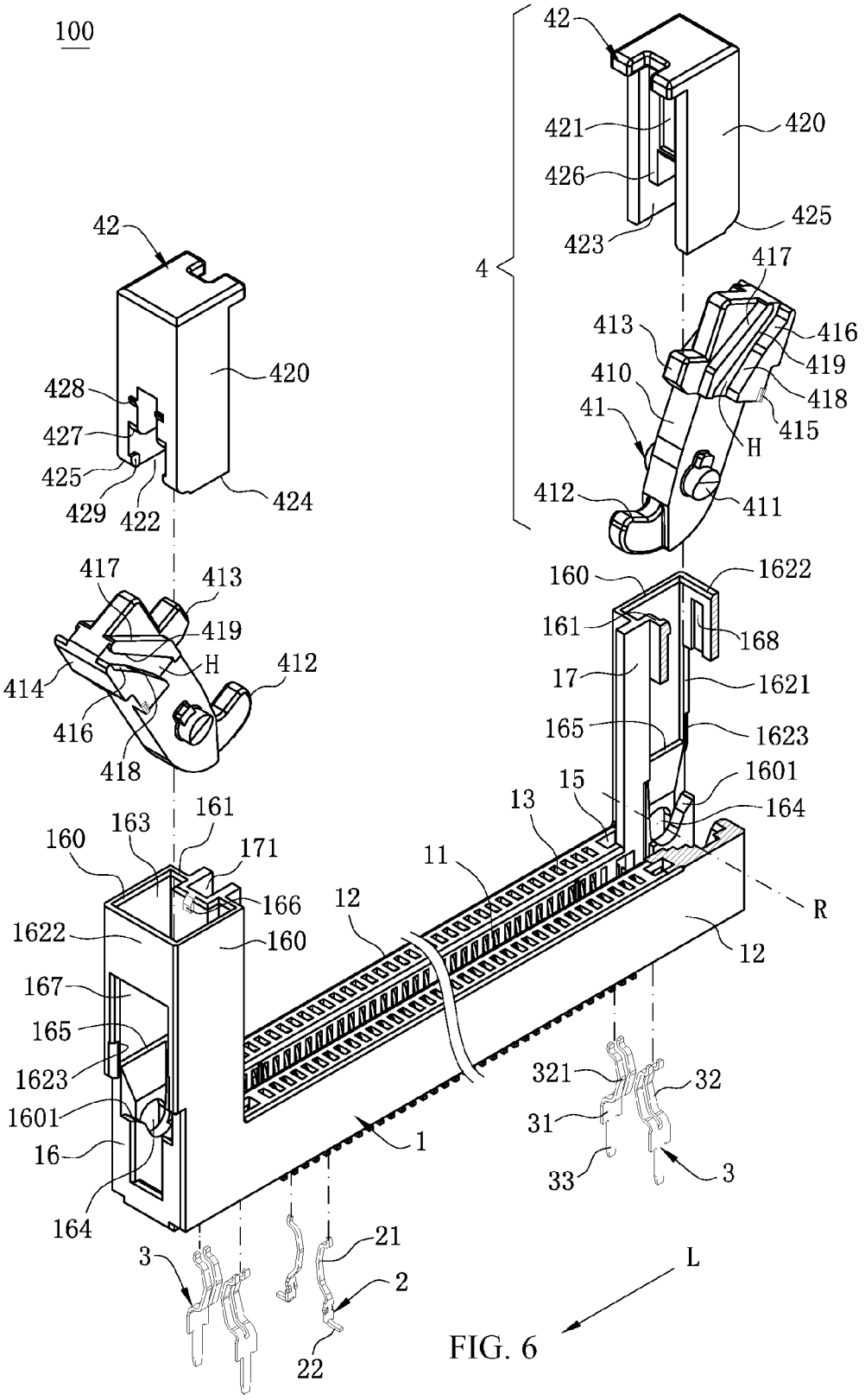
FIG. 6 is a part sectional view of FIG. 4.

Referring to FIG. 4 and FIG. 6, a mounting portion 16 is arranged at each of the two ends of the insulating body 1, the mounting portion 16 is provided with two lateral walls 160 oppositely arranged and two end walls, the two end walls include an inner end wall 161 and an outer end wall 162, the two lateral walls 160, the inner end wall 161 and the outer end wall 162 enclose a receiving groove 163, and the bottom of the receiving groove 163 is communicated with the central slot 11. Each lateral wall 160 is provided with a pivoting hole 164 and a stopping portion 165, the stopping portion 165 is positioned over the pivoting hole 164, and the stopping portion 165 is a horizontal plane. Each inner end wall 161 is provided with a first protruding block 166 protruding towards the receiving groove 163. Each outer end wall 162 is provided with a through slot 167 communicated with the receiving groove 163, the through slot 167 penetrates through the outer end wall 162 along the longitudinal direction L, the through slot 167 is positioned at the lower end of the outer end wall 162, a part above the through slot 167 is sealed, that is, the outer end wall 162 is provided with two side portions 1621 positioned on the two sides of the through slot 167 and a connecting portion 1622 positioned above the through slot 167, and the connecting portion 1622 is connected to the upper ends of the two side portions 1621. A buckling portion 1623 is arranged on each side portion 1621, and the buckling portion 1623 is positioned above the stopping portion 165 in a vertical direction. Each outer end wall 162 is provided with two first sliding chutes 168 on the connecting portion 1622, the first sliding chutes 168 are formed by sinking from the inner surface of the outer end wall 162, and the first sliding chutes 168 are communicated with the through slot 167 in the vertical direction. A guide portion 1601 connected with the pivoting hole 164 is also arranged on each lateral wall 160, the guide portion 1601 is communicated with the outside of the insulating body 1 in the longitudinal direction L, the two guide portions 1601 are positioned on the two sides of the through slot 167, and in this embodiment, the guide portion 1601 is a guide slot. A reinforcing rib 17 protrudes and extends from each of the two sides of each mounting portion 16, and a clamping slot 171 configured to clamp the corresponding side edge 204 to make the electronic card 200 unlikely to shake is formed between the two reinforcing ribs 17.

Figure 5:
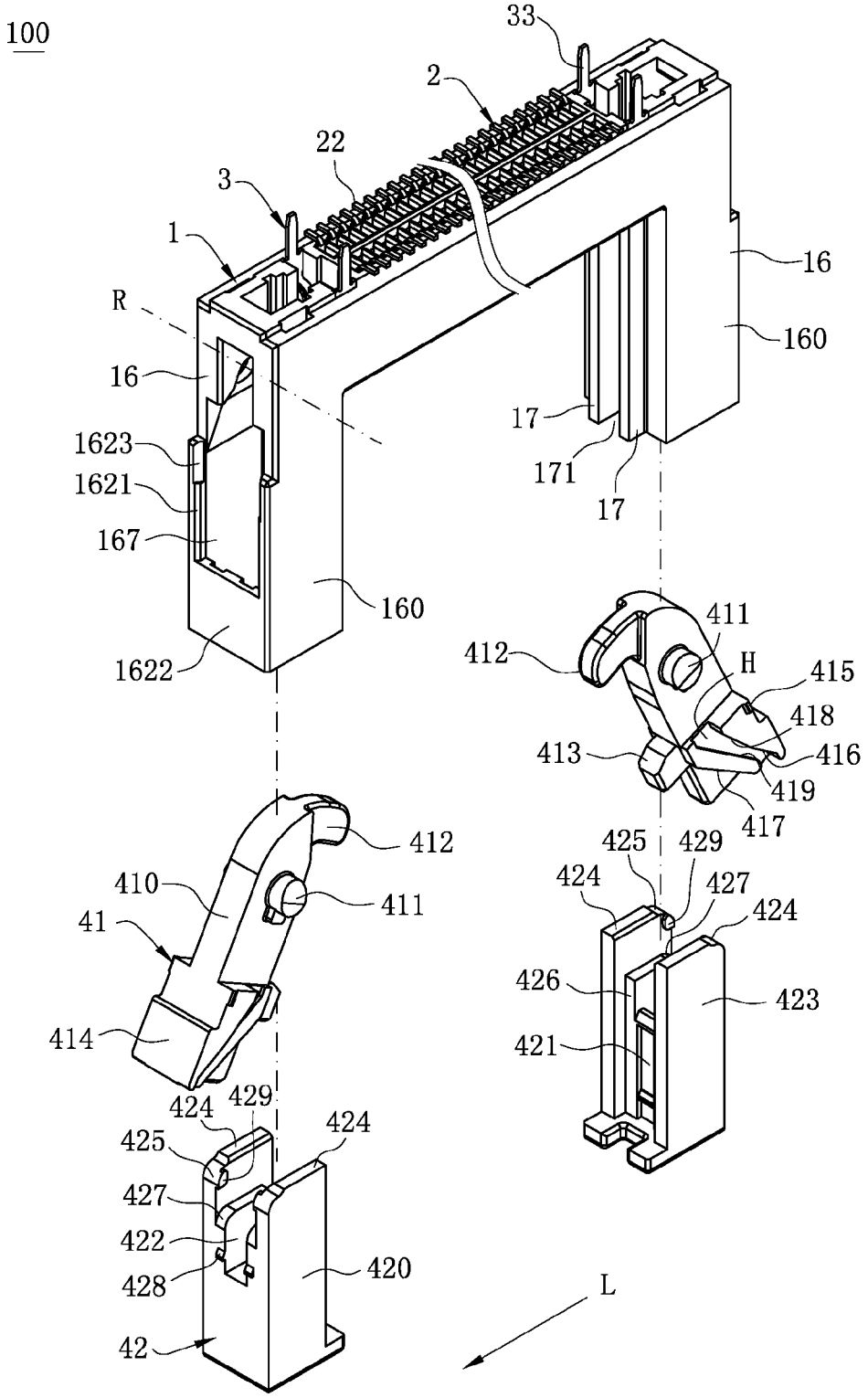
FIG. 5 is a three-dimensional view from another viewing angle of view after

Referring to FIG. 2, FIG. 5 and FIG. 6, the multiple conductive terminals 2 are correspondingly arranged in the multiple terminal housings 13 on the two sides of the central slot 11. Each conductive terminal 2 is provided with a contact portion 21 protruding and extending into the central slot 11 and configured to contact with the corresponding first conductive sheet 202 to form electrical connection, each conductive terminal 2 is also provided with a soldering pin 22 exposed to the bottom of the insulating body 1, and the soldering pin 22 is connected with the corresponding conductive spacer 301 in a surface-mount soldering manner.

Referring to FIG. 6, the multiple power terminals 3 are correspondingly arranged in the multiple power terminal holes 15 at the two sides of the central slot 11. The power terminals 3 in this embodiment are power terminals additionally arranged on the basis of a known card edge connector. The conductive terminals of a known card edge connector have terminals used as power supplies, and after the power terminals 3 are additionally arranged, the terminals used as the power supplies in the known conductive terminals can be configured to transmit signals, so that the transmission rate of the card edge connector 100 of the present invention can be increased.

Referring to FIG. 2 and FIG. 6, each power terminal 3 is provided with a retaining portion 31, two contact arms 32 upwards extending from the retaining portion 31 and a connecting pin 33 downwards extending from the retaining portion 31. Each contact arm 32 is provided with a contact point 321, and the two contact points 321 of the same power terminal 3 contact with the same power conductive sheet 203 to form electrical connection. Each connecting pin 33 is of a direct insertion type, is inserted into the corresponding jack 302, can form electrical connection with the circuit board 300, and can be also used as a fixing iron pin of the card edge connector 100 for limiting the card edge connector 100 instead of an iron pin for fixing. In other embodiments, there can be arranged only one power terminal 3, and the power terminal 3 can be arranged between the fool-proof portion 14 and the conductive terminal 2 adjacent to the fool-proof portion 14.

Figure 8:
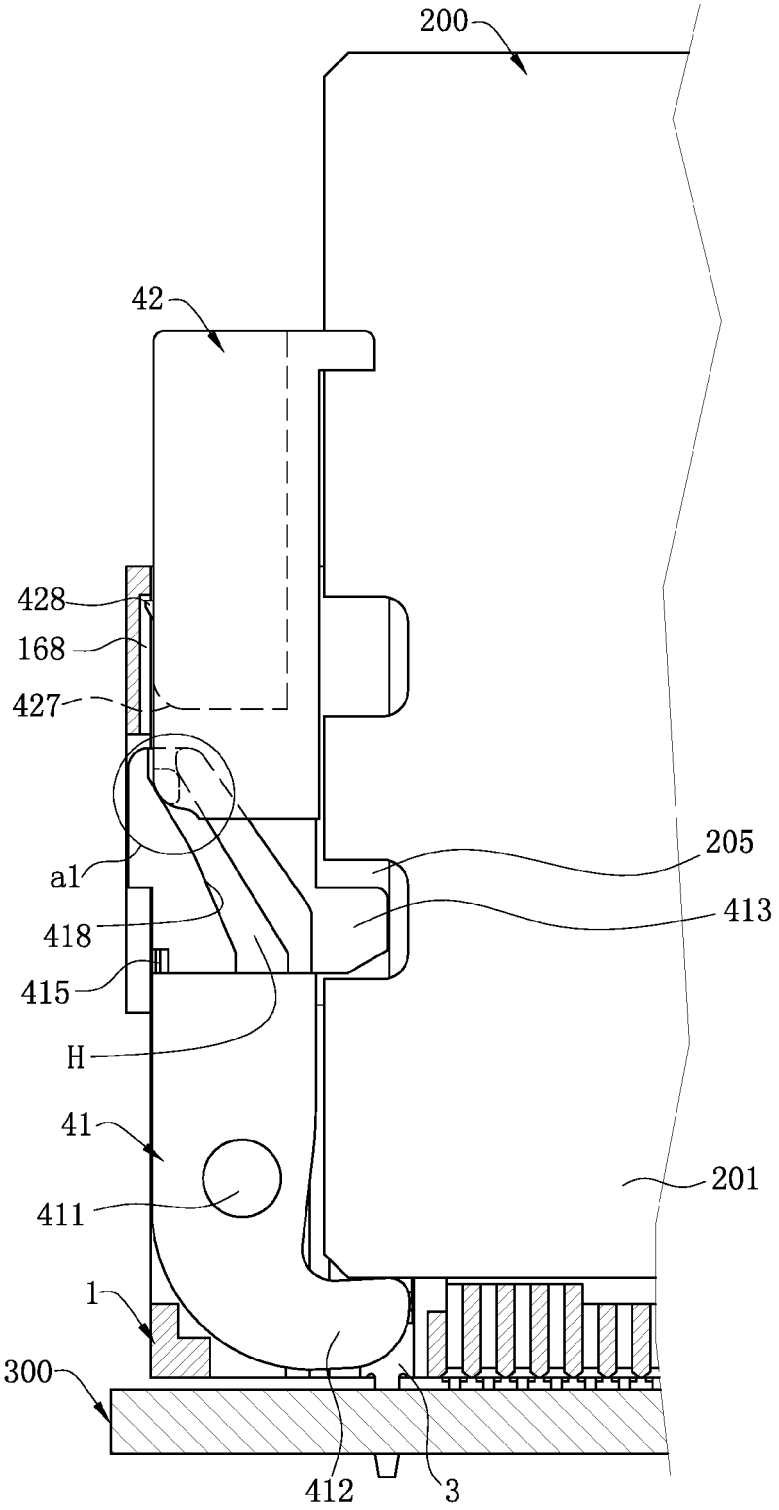
FIG. 8 is a sectional view along an A-A line in FIG. 1.
Figure 9:
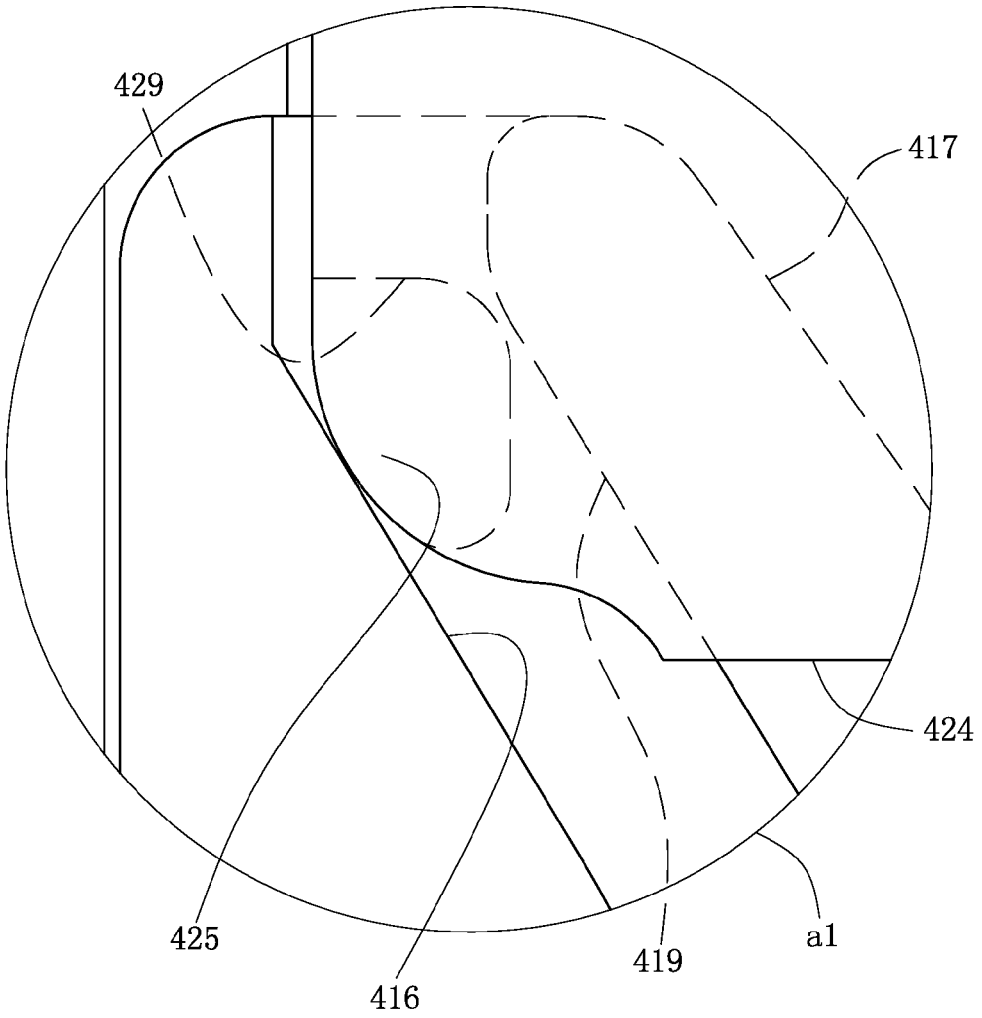
FIG. 9 is an enlarged view of a1 in FIG. 8.
Figure 13:
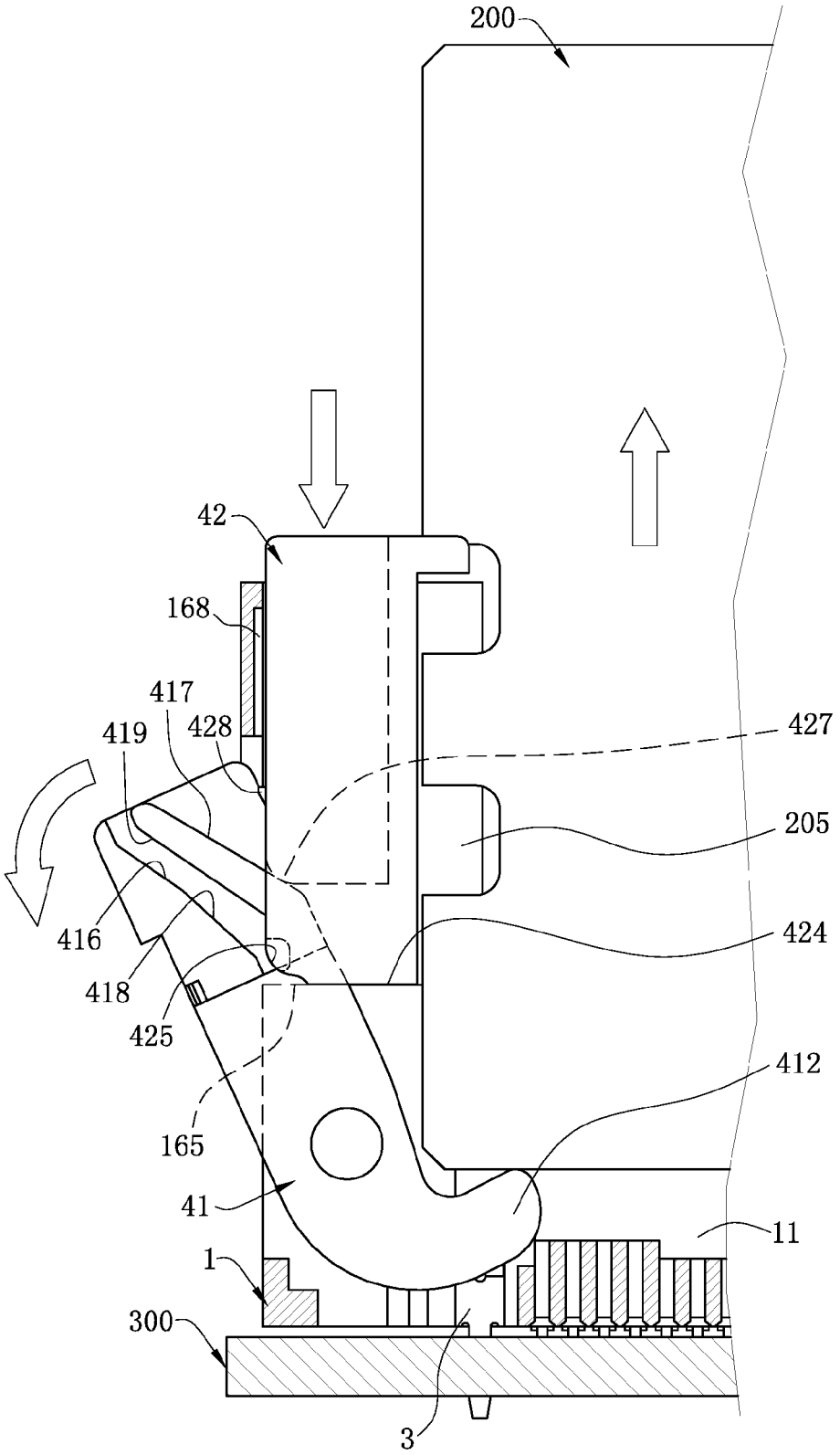
FIG. 13 is a schematic diagram illustrating that a pressing member moves downwards until the rotating member is completely in an open state in FIG. 8.

Referring to FIG. 2, FIG. 3 and FIG. 6, the latch devices 4 are mounted in the receiving groove 163, and the two latch devices 4 are symmetrically arranged at the two ends of the insulating body 1. Each latch device 4 is provided with a rotating member 41 and a pressing member 42. Each rotating member 41 is provided with a main body portion 410, a rotating shaft 411 is arranged on each of the two lateral surfaces of the main body portion 410, the rotating shaft 411 is mounted in the corresponding pivoting hole 164 from the through slot 167 under guidance of the corresponding guide portion 1601 to form matching between the rotating shaft 411 and the pivoting hole 164 and form a rotating axis R therebetween, and the rotating member 41 can implement outward opening and inward latching operations around the rotating axis R in the longitudinal direction L. Referring to FIG. 8 and FIG. 13, a card ejecting portion 412 configured to withdraw the electronic card 200 extends from the lower end of each main body portion 410 to the central slot 11, the two opposite power terminals 3 at the same end of the insulating body 1 define a plane, and no matter whether the rotating members 41 are in an open or latched state, the card ejecting portions 412 pass beyond the contact points 321 in the longitudinal direction L. A latch portion 413 configured to be latched in the corresponding notch 205 extends from the upper end of each main body portion 410 toward the central slot 11, and when the latch portions 413 are latched in the notches 205, the rotating members 41 are hidden in the insulating body 1. A head portion 414 is formed at the upper end of each main body portion 410, a protrusion 415 is arranged on each of the two sides of the head portion 414, the protrusion 415 is arranged above the corresponding rotating shaft 411, and the protrusion 415 is configured to be buckled with the corresponding buckling portion 1623.

Figure 7:
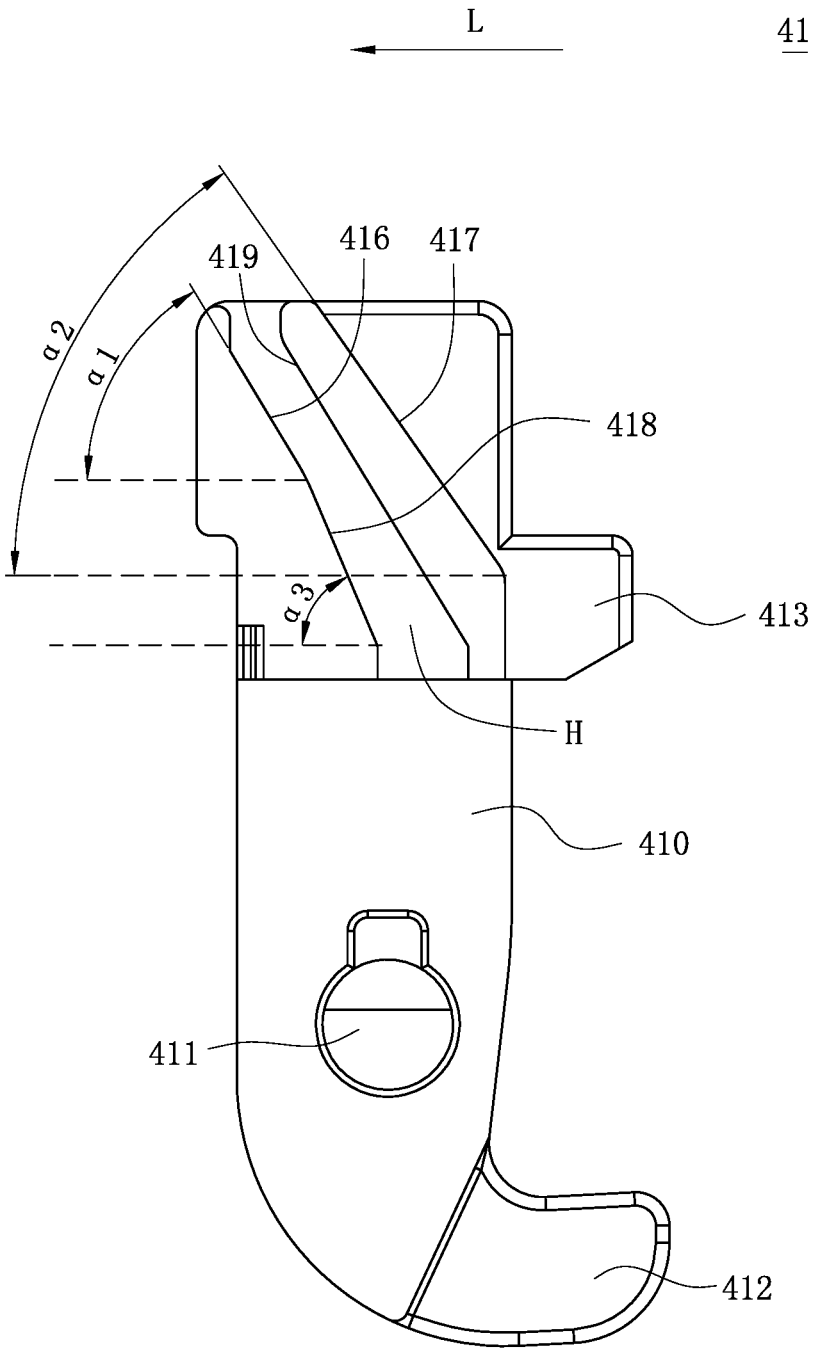
FIG. 7 is a front view of a rotating member in the latched state.

Referring to FIG. 4 and FIG. 7, a first crimping chamfer 416, a second crimping chamfer 417 and a third crimping chamfer 418, which are inclined upwards and arranged towards the central slot 11, are also arranged on the two sides of the head portion 414 respectively, the first crimping chamfer 416 and the second crimping chamfer 417 are disposed with an interval therebetween, the second crimping chamfer 417 is positioned obliquely above the first crimping chamfer 416, the third crimping chamfer 418 is connected with the first crimping chamfer 416 end to end, an angle between the first crimping chamfer 416 and the longitudinal direction L is a first angle $\alpha 1$, an angle between the second crimping chamfer 417 and the longitudinal direction L is a second angle $\alpha 2$, an angle between the third crimping chamfer 418 and the longitudinal direction L is a third angle $\alpha 3$, and in this embodiment, the first angle $\alpha 1$, the second angle $\alpha 2$ and the third angle $\alpha 3$ are acute angles, angle values range between 40°~75°, such as 40°, 45°, 50°, 55°, 60°, 65°, 70° or 75°, the first crimping chamfer 416 and the second crimping chamfer 417 are arranged substantially in parallel (that is, $\alpha 1 \approx \alpha 2$), and the third angle $\alpha 3$ is larger than the first angle $\alpha 1$. A limiting portion which is arranged obliquely downwards is also arranged on each of the two sides of each head portion 414, in this embodiment, the limiting portion is a limiting surface 419, and is arranged substantially in parallel with the first crimping chamfer 416, the limiting surface 419 is positioned between the first crimping chamfer 416 and the second crimping chamfer 417, the limiting surface 419 faces the first crimping chamfer 416 and the third crimping chamfer 418 on a corresponding side, and the first crimping chamfer 416, the third crimping chamfer 418 and the limiting surface 419 together form a slide rail H.

Referring to FIG. 4 and FIG. 5, the periphery of each pressing member 42 is matched with the corresponding two lateral walls 160, the corresponding inner end wall 161 and the corresponding outer end wall 162, so that the pressing member 42 moves vertically relative to the insulating body 10. Each pressing member 42 is provided with a body portion 420, a second sliding chute 421 is formed by sinking into a surface, facing the central slot 11, of the body portion 420, and the first protruding blocks 166 protrude and extend toward the second sliding chutes 421, so as to guide and limit the position of the first protruding blocks 166. A slot 422 is formed by upward sinking into the bottom edge of each pressing member 42, the slot 422 is positioned below the corresponding second sliding chute 421, and penetrates through the pressing member 42 in the longitudinal direction L, and the slot 422 provides a reserved space sufficient to accommodate the corresponding head portion 414 when the corresponding rotating member 41 rotates. A first extending portion 423 is arranged on each of the two sides of each slot 422, the first extending portion 423 is formed by downward extending from the lower end of the body portion 420, and the bottom edge of each first extending portion 423 is a halting portion 424. In a downward movement process of the pressing member 42, the halting portion 424 is eventually halted by the stopping portion 165 so that the pressing member 42 cannot continue moving downwards. A first arc-shaped actuating portion 425 is formed at a junction of the bottom edge of the first extending portion 423 and an outer lateral surface, facing away from the central slot 11, of the first extending portion 423, the first actuating portion 425 is configured to slide on the first crimping chamfer 416, and the first actuating portion 425 can also slide on the third crimping chamfer 418 when required by a situation. Each of the two opposite sides of each slot 422 extends from the body portion 420 toward the bottom edge of the pressing member 42 to form a second extending portion 426, the extending length of the second extending portion 426 is smaller than the extending length of the first extending portion 424, the extending portions 426 are positioned between the two first extending portions 423, and on a corresponding side of the slot 422, a first extending portion 423 is connected with a corresponding second extending portion 426. A second actuating portion 427 is formed at the end of each second extending portion 426. In this embodiment, the second actuating portion 427 is formed in arc-shaped at a junction of the bottom edge of the second extending portion 426 and an outer lateral surface, facing away from the central slot 11, of the second extending portion 426. The second actuating portion 427 is configured to slide on the corresponding second crimping chamfer 417. Each pressing member 42 is also provided with two second protruding blocks 428 positioned on the two sides of the slot 422, the second protruding blocks 428 are arranged on an outer lateral surface, facing away from the central slot 11, of the pressing member 42, and the second protruding blocks 428 protrude and extend toward the corresponding first sliding chutes 168, so that the positions of the second protruding blocks 428 are guided and limited, and the pressing member 42 is limited in the corresponding receiving groove 163. Each of the two opposite sides of the slot 422 of each pressing member 42 oppositely protrudes and extends towards the interior of the slot 422 to form a flange 429, the flange 429 is arranged close to the first actuating portion 425 on the corresponding side of the slot 422, and the flange 429 is configured to slide in the corresponding slide rail H.

Referring to FIG. 8 to FIG. 13, when the latch devices 4 release the electronic card 200 in two stages, in the first stage, a user presses the pressing members 42 downwards, the first actuating portions 425 abuts against the first crimping chamfers 416 at first, at this moment, the second actuating portions 427 do not contact with the second crimping chamfers 417, only the first actuating portions 425 slide along the first crimping chamfers 416 to cause the rotating members 41 to start rotating outwards under the pressure of the pressing members 42, and along with downward movement of the pressing members 42, the distances from action points between the pressing members 42 and the rotating members 41 to the rotating shafts 411 are shortened, and force required by the user for pressing the pressing members 42 becomes stronger. After the pressing members 42 move downwards by a certain distance, that is, the first actuating portions 425 move to junctions of the first crimping chamfers 416 and the third crimping chamfers 418, the second stage is started, at this moment, the second actuating portions 427 start contacting with the second crimping chamfers 417, while the first actuating portions 425 start being separated from the first crimping chamfers 416, force is continued to be applied to the pressing members 42, the distances from the action points between the pressing members 42 and the rotating members 41 to the rotating shafts 411 increase again because the second crimping chamfers 417 are positioned obliquely above the first crimping chamfers 416, which causes the force required by the user for pressing the pressing members 42 to be suddenly decreased. The second actuating portions 427 slide along the second crimping chamfers 417 to cause the rotating members 41 to continue rotating outwards under the pressure of the pressing members 42, the distances from the action points between the pressing members 42 and the rotating members 41 to the rotating shafts 411 becomes shorter again, and the force required by the user for pressing the pressing members 42 becomes stronger again. When the halting portions 424 are limited by the stopping portions 165 in the downward movement process of the pressing members 42, the pressing members 42 cannot continue moving downwards, and at this moment, the rotating members 41 are in a completely open state. In the foregoing two stages, the flanges 429 slide in the slide rails H all the time.

Referring to FIG. 7 and FIG. 8, pressing force required to be applied to the pressing members 42 by the user becomes weaker if the angle values of the first angle $\alpha 1$, the second angle $\alpha 2$ and the third angle $\alpha 3$ get more approximate to 90°, relatively strong force is required to press the pressing members 42 if the angle values of the first, second and third angles $\alpha 1$, $\alpha 2$ and $\alpha 3$ are smaller than 40°. If the angle values of the first angle $\alpha 1$, the second angle $\alpha 2$ and the third angle $\alpha 3$ are more approximate to 90°, for the rotating members 41 to completely withdraw the electronic card 200, the pressing members 42 are required to move downwards by a longer distance, and an outward rotating angle of the rotating members 41 becomes greater. Considering the foregoing factors, the angle values of the first angle $\alpha 1$, the second angle $\alpha 2$ and the third angle $\alpha 3$ range between 40°~75°, and in this angle range, each factor mentioned above can be balanced to enable the latch devices 4 to work in a better state.

Figure 10:
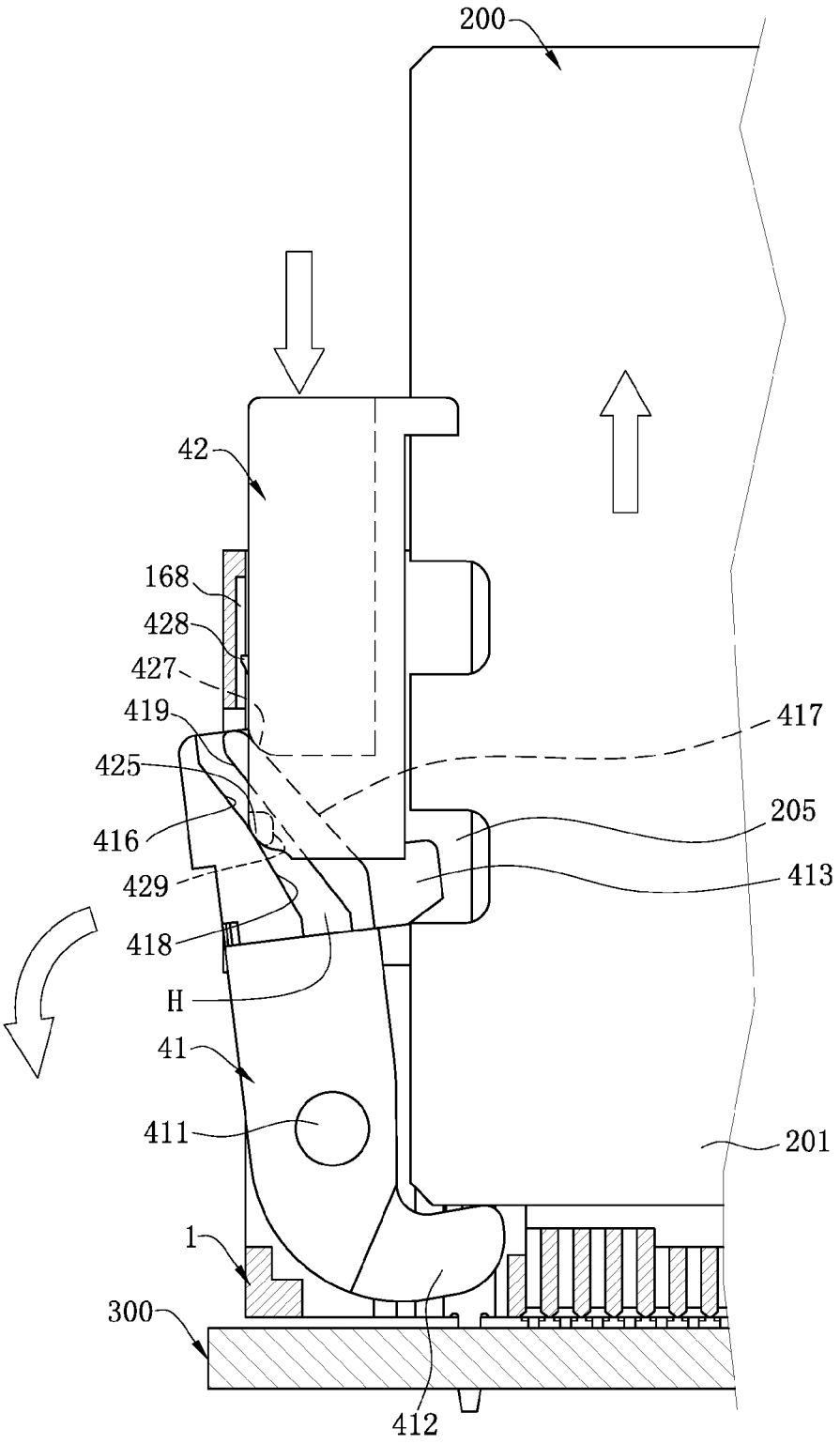
FIG. 10 is a schematic diagram illustrating that a first actuating portion is about to leave a first crimping chamfer and a second actuating portion starts contacting with a second crimping chamfer in FIG. 8.
Figure 11:
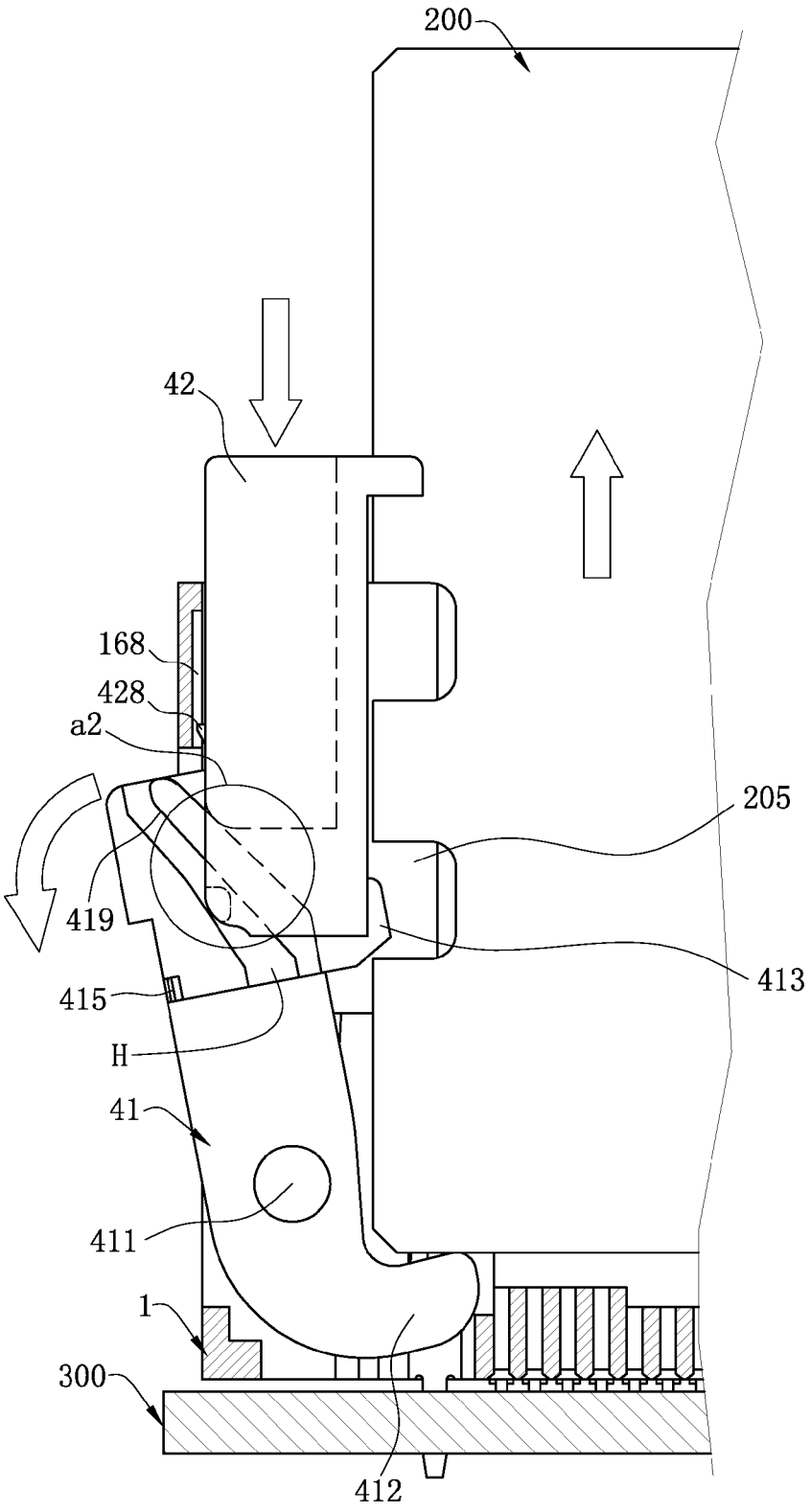
FIG. 11 is a schematic diagram illustrating that the first actuating portion leaves the first crimping chamfer and the second actuating portion slides on the second crimping chamfer in FIG. 8.
Figure 12:
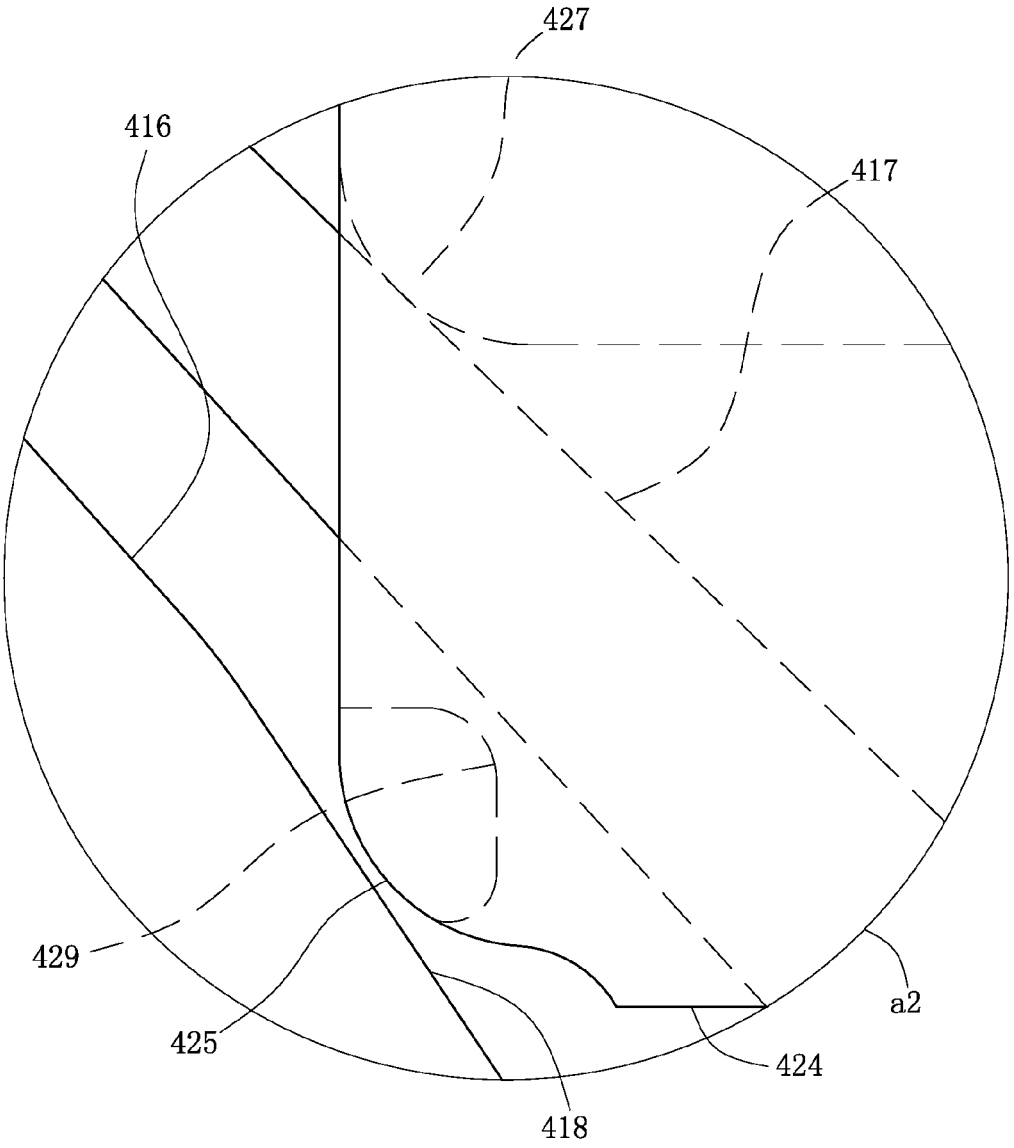
FIG. 12 is an enlarged view of a2 in FIG. 11.

Referring to FIG. 6, FIG. 10 and FIG. 11, in the foregoing second stage, the first actuating portions 425 do not contact with the third crimping chamfer 418, and there are gaps between the first actuating portions 425 and the third crimping chamfer 418. And when the second actuating portions 427 chafes against the second crimping chamfer 417, as a compensation mechanism, the first actuating portions 425 and the third crimping chamfer 418 contact and slide relative to each other, and the second stage process of the pressing members 42 acting on the rotating members 41 finishes. And certainly, the first actuating portions 425 can also contact with and slide relative to the third crimping chamfers 418, and can simultaneously be matched with the sliding of the second actuating portions 427 on the second crimping chamfer 417. In the downward movement process of the pressing members 42, action points between the first actuating portions 425 and the first crimping chamfer 416, between the first actuating portions 425 and the third crimping chamfer 418, and between the second actuating portions 427 and the second crimping chamfer 417 are all positioned on the outer side of the rotating axe R in the longitudinal direction L, so as to avoid a scenario that the rotating members 41 cannot further rotate outwards when the action points between the pressing members 42 and the rotating members 41 are positioned along the same straight line with the rotating axes R in a vertical plane. Further, in the outward rotating process of the rotating members 41, the action points between the first actuating portions 425 and the first crimping chamfer 416 move downwards relatively on the first crimping chamfers 416, and the action points between the second actuating portions 427 and the second crimping chamfer 417 move downwards relatively on the second crimping chamfers 417.

Referring to FIG. 8 to FIG. 13, the forces applied when inserting the electronic card 200 into the central slot 11 and when releasing the electronic card 200 are opposite to each other. The insertion end 201 downwards abuts against and presses the card ejecting portions 412 to cause the rotating members 41 to rotate inwards, and at this moment, the second crimping chamfer 417 and the first crimping chamfer 416 sequentially upwards abut against and press the second actuating portions 427 and the first actuating portions 426 to cause the pressing members 42 to move upwards and cause the latch portions 413 to be latched in the notches 205.

Figure 14:
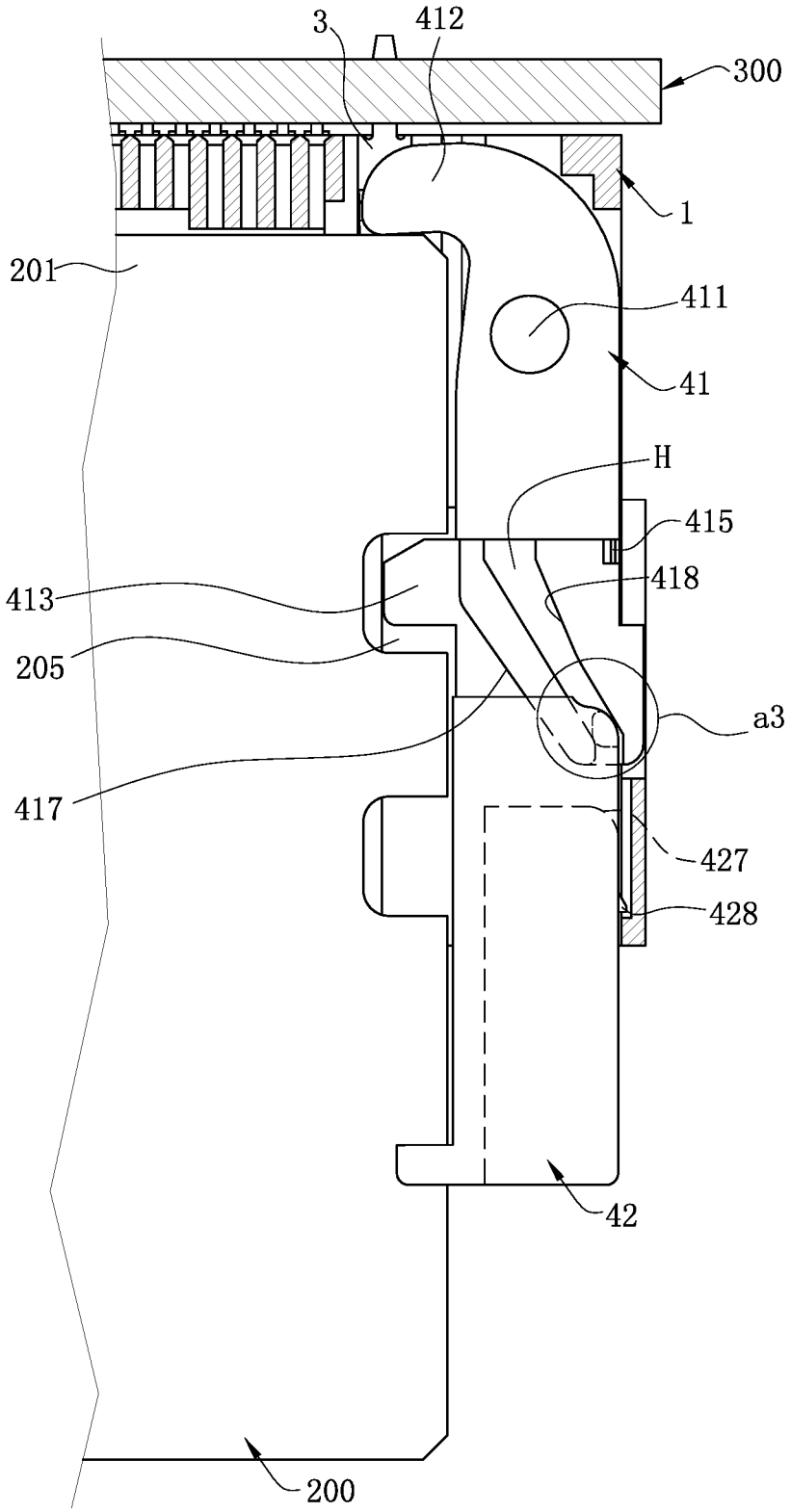
FIG. 14 is an inverted schematic diagram of the card edge connector in FIG. 8.
Figure 15:
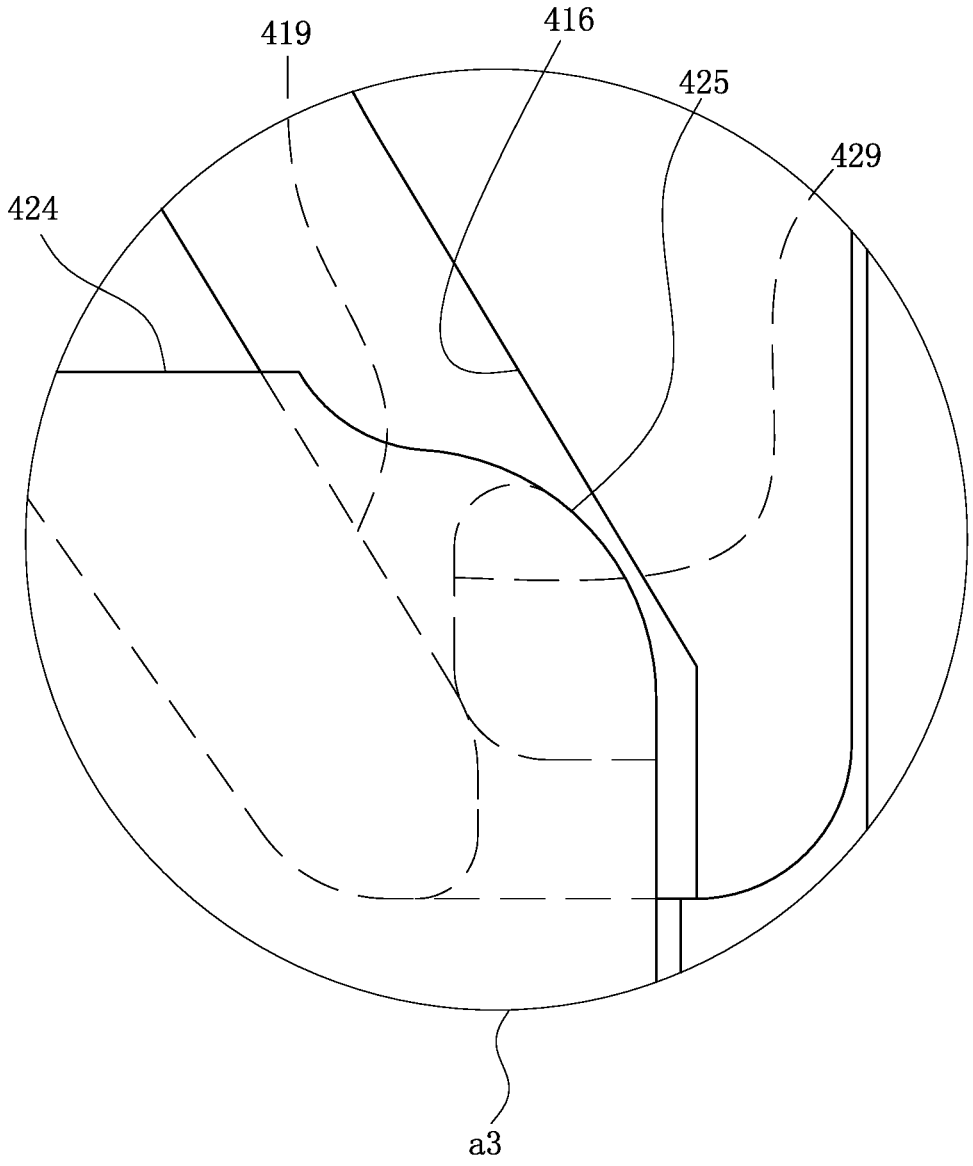
FIG. 15 is an enlarged view of a3 in FIG. 14.

Referring to FIG. 14 to FIG. 15, in an impact test of the card edge connector 100, the card edge connector 100 is inverted, that is, the card edge connector 100 is positioned below the circuit board 300, so that under an impact, the electronic card 200 tends to drop downwards, and the latch portions 413 tend to be separated from the notches 205. When the card edge connector 100 is inverted, the positions of the pressing members 42 are limited by the mounting portions 16, and the pressing members 42 and the mounting portions 16 are kept relative still. The flanges 429 abut against and press the limiting surfaces 419 to exert a force on the head portion 414 toward the central slot 11, and to limit the rotating member 41 from rotating outwards, ensuring the latch portions 413 are fastened to the notches 205 and avoiding the electronic card 200 being separated from the central slot 11 in the impact test.

Figure 16:
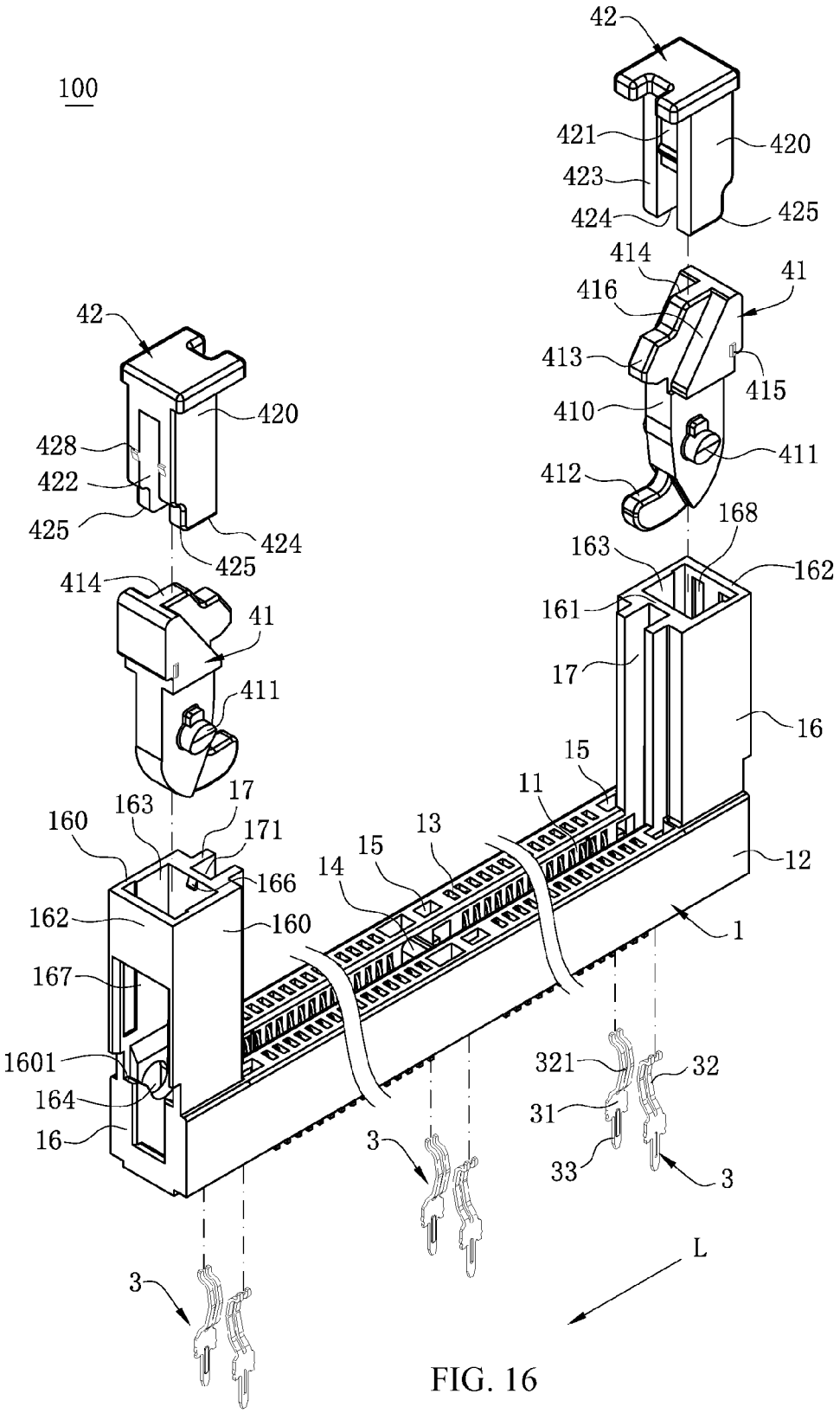
FIG. 16 is a three-dimensional exploded view of a card edge connector according to a second embodiment of the present invention.

Referring to FIG. 16, a second embodiment of the present invention is shown, and a difference between the second embodiment and the foregoing first embodiment is that: each rotating member 41 is provided with only one crimping chamfer, each pressing member 42 is provided with only one actuating portion, for example, there is only the first crimping chamfer 416 and the first actuating portion 425, and the first actuating portion 425 can slide on the first crimping chamfer 416 to finish all the downward movement stroke of the pressing member 42. Similarly, the value of the angle between the first crimping chamfer 416 and the longitudinal direction L ranges between 40°~75°, and the angle value of the angle can be 40°, 45°, 50°, 55°, 60°, 65°, 70° or 75°.

In an alternative embodiment, certainly, the first crimping chamfers 416, the second crimping chamfers 417, the third crimping chamfers 418 and the limiting surfaces 419 can be arranged on the pressing members 42, and the first actuating portions 425, the second actuating portions 427 and the flanges 429 are arranged on the rotating members 41; or each of the rotating members 41 and the pressing members 42 is provided with a crimping chamfer and an actuating portion, for example, the first crimping chamfers 416 and the second actuating portions 427 are arranged on the rotating members 41, the first actuating portions 425 and the second crimping chamfers 417 are arranged on the pressing members 42, and under the foregoing two scenarios, the pressing members 42 and the rotating members 41 can also slide in two stages to open the rotating members 41.

To sum up, the card edge connector of the present invention has the following beneficial effects.

1. The first crimping chamfers 416 and the second crimping chamfers 417 are disposed with an interval therebetween, the second crimping chamfers 417 are positioned obliquely above the first crimping chamfers 416, sliding of the first actuating portions 425 on the first crimping chamfers 416 is before sliding of the second actuating portions 427 on the second crimping chamfers 417, which makes the distances from the action points between the pressing members 42 and the rotating members 41 to the rotating shafts 411, at the beginning of the second stage, to suddenly change and increase, as compared with those in the first stage, and therefore, the force required from the user for pressing the pressing members 42 also decreases suddenly. Compared with a scenario that the pressing members 42 move vertically in the same stroke and slide in a single stage, to adopt the two stages to finish the stroke of the pressing members 42 can make the rotating members 41 abut against and push the electronic card 200 through a user's applying only a relatively weak force to the pressing members 42.

2. The rotating members 41 are provided with the limiting surfaces 419, the pressing members 42 are provided with the flanges 429 matched with the limiting surfaces 419. In the impact test of the card edge connector 100, the card edge connector 100 is inverted, that is, the positions of the pressing members 42 are limited by the mounting portions 160, the pressing members 42 and the mounting portions 160 are kept relative still and the flanges 429 abut against and press the limiting surfaces 419 to exert a force on the head portion 414 toward the central slot 11, and to limit the rotating member 41 from rotating outwards, ensuring the latch portions 413 are fastened to the notches 205 and avoiding the electronic card 200 being separated from the central slot 11 in the impact test.

3. The pressing force required to be applied to the pressing members 42 by the user becomes weaker if the angle values of the first angle $\alpha 1$, the second angle $\alpha 2$ and the third angle $\alpha 3$ get more approximate to 90°, the relatively strong force is required to press the pressing members 42 if the angle values of the first, second and third angles $\alpha 1$, $\alpha 2$ and $\alpha 3$ are smaller than 40°. If the angle values of the first angle $\alpha 1$, the second angle $\alpha 2$ and the third angle $\alpha 3$ are more approximate to 90°, for the rotating members 41 to completely withdraw the electronic card 200, the pressing members 42 are required to move downwards by a longer distance, and an outward rotating angle of the rotating members 41 becomes greater. Considering the foregoing factors, the angle values of the first angle $\alpha 1$, the second angle $\alpha 2$ and the third angle $\alpha 3$ range between 40°~75° (for example, 40°, 45°, 50°, 55°, 60°, 65°, 70° or 75°, and in this angle range, each factor mentioned above can be balanced to enable the latch devices 4 to work in a better state.

4. The electronic card 200 is provided with the power conductive sheets 203 under the notches 205, the power terminals 3 are electrically connected with the power conductive sheets 203 when the electronic card 200 is inserted into the central slot 11, and since the power conductive sheets 203 are arranged under the notches 205, the power conductive sheets 203 can be added while maintaining an original size of the electronic card 200 along the longitudinal direction L. That is, the requirement of adding power terminals 3 on the card edge connector 100 can be met without additionally increasing the length of the electronic card 200 along the longitudinal direction L.

5: The card edge connector 100 is additionally provided with the power terminals 3. The power terminals 3 are power terminals additionally arranged on the basis of a known card edge connector 100. The conductive terminals of a known card edge connector have terminals used as power supplies, and after the power terminals 3 are additionally arranged, the terminals used as the power supplies in the known conductive terminals can be configured to transmit signals, so that the transmission rate of the card edge connector 100 of the present invention can be increased.

The above detailed description only describes preferable embodiments of the present invention, and is not intended to limit the patent scope of the present invention, so any equivalent technical changes made by use of the specification of the creation and the content shown in the drawings fall within the patent scope of the present invention.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A card edge connector, configured to electrically connect an electronic card, and comprising:

an insulating body, having a central slot extending along a longitudinal direction and adapted to insert the electronic card;

a plurality of conductive terminals, arranged on the insulating body, each having a contact portion protruding and extending into the central slot and configured to be electrically connected with the electronic card; and at least one latch device, arranged at one end of the insulating body, comprising a rotating member pivoted to the insulating body, having a latch portion, configured to latch the electronic card; and a card ejecting portion, configured to abut against and push the electronic card; and a pressing member, configured to press the rotating member and move vertically relative to the insulating body, wherein one of the rotating member and the pressing member has a first crimping chamfer and a second crimping chamfer, and the other one of the rotating member and the pressing member slides on the first crimping chamfer before sliding on the second crimping chamfer.

2. The card edge connector according to claim 1, wherein the other one of the rotating member and the pressing member has a first actuating portion and a second actuating portion, and the first actuating portion slides on the first crimping chamfer before the second actuating portion slides on the second crimping chamfer.

3. The card edge connector according to claim 2, wherein the first crimping chamfer and the second chamfer are disposed with an interval therebetween, one of the rotating member and the pressing member has a third crimping chamfer connected end to end with the first crimping chamfer, and when the first actuating portion slides on and along the third crimping chamfer, the second actuating portion slides on and along the second crimping chamfer correspondingly.

4. The card edge connector according to claim 3, wherein an angle between the third crimping chamfer and the longitudinal direction is greater than an angle between the first crimping chamfer and the longitudinal direction.

5. The card edge connector according to claim 2, wherein the first crimping chamfer and the second crimping chamfer are arranged on the rotating member, a slot is formed on a bottom edge of the pressing member and penetrates through the pressing member along the longitudinal direction, the first actuating portion is formed on each of two opposite sides of the slot on the bottom edge of the pressing member, the two opposite sides of the slot extend toward the bottom edge of the pressing member respectively to form a plurality of extending portions, and the second actuating portion is formed at each of ends of the extending portions.

6. The card edge connector according to claim 1, wherein the rotating member rotates relative to the insulating body around an axis of a rotating shaft, and action points of the other one of the rotating member and the pressing member on the first crimping chamfer and on the second crimping chamfer are consistently located further away from the central slot along the longitudinal direction than the axis is.

7. The card edge connector according to claim 1, wherein at least one end of the insulating body has a mounting portion having a receiving groove;

two lateral walls positioned on two opposite sides of the receiving groove; and at least one end wall, having a through slot, penetrating through the end wall along the longitudinal direction and communicated with the receiving groove and; and a connecting portion, positioned above the through slot and connected to the two lateral walls; and wherein when the ejecting portion completely abuts against and pushes the electronic card, the rotating member is at least partially exposed to the insulating body through the through slot, and when the latch portion latches the electronic card, the rotating member is completely hidden in the mounting portion.

8. The card edge connector according to claim 7, wherein the end wall has two side portions positioned on two sides of the through slot, the connecting portion is connected to upper ends of the two side portions, and the rotating member has a protrusion buckled to the side portions.

9. A card edge connector, configured to electrically connect an electronic card, and comprising:

an insulating body, having a central slot extending along a longitudinal direction and adapted to insert the electronic card;

a plurality of conductive terminals arranged on the insulating body, each conductive having a contact portion protruding and extending into the central slot and configured to be electrically connected with the electronic card; and at least one latch device arranged at one end of the insulating body, comprising a rotating member pivoted to the insulating body, having a card ejecting portion and a latch portion; and a pressing member configured to press the rotating member downwards and move vertically relative to the insulating body, wherein one of the rotating member and the pressing member has at least one crimping chamfer and a limiting portion, the other one of the rotating member and the pressing member has at least one actuating portion and at least one flange, the actuating portion slides on and along the crimping chamfer to cause the rotating member to rotate and cause the card ejecting portion to abut against and push the electronic card when the pressing member presses the rotating member, and a position of the flange is limited by the limiting portion to avoid the latch portion from being separated from the electronic card when the latch portion latches the electronic card.

10. The card edge connector according to claim 9, wherein the at least one crimping chamfer comprises a first crimping chamfer and a second crimping chamfer, disposed with an interval therebetween, the limiting portion is positioned between the first crimping chamfer and the second crimping chamfer, the pressing member presses the rotating member to cause the flange to slide between the first crimping chamfer and the limiting portion, and the actuating portion slides on the first crimping chamfer before the actuating portion slides on the second crimping chamfer.

11. The card edge connector according to claim 10, wherein the at least one crimping chamfer further comprises a third crimping chamfer connected end to end with the first crimping chamfer, and an angle between the third crimping chamfer and the longitudinal direction is greater than an angle between the first crimping chamfer and the longitudinal direction.

12. The card edge connector according to claim 10, wherein the at least one actuating portion comprises a first actuating portion and a second actuating portion, and first actuating portion slides on the first crimping chamfer before the second actuating portion slides on the second crimping chamfer.

13. The card edge connector according to claim 9, wherein the at least one crimping chamfer and the limiting portion are arranged on the rotating member, a slot is formed on a bottom edge of the pressing member and penetrates through the pressing member along the longitudinal direction, the at least one actuating portion is formed on each of the two opposite sides of the slot on the bottom edge of the pressing member, and the two opposite sides of the actuating portion protrude and extend toward each other to form the at least one flange.

14. A card edge connector, configured to electrically connect an electronic card, and comprising:

an insulating body, having a central slot extending along a longitudinal direction and adapted to insert the electronic card;

a plurality of conductive terminals arranged on the insulating body, each having a contact portion protruding and extending into the central slot and configured to be electrically connected with the electronic card; and at least one latch device, arranged at one end of the insulating body, comprising a rotating member pivoted to the insulating body, having a card ejecting portion and a latch portion configured to latch the electronic card; and a pressing member, configured to move vertically relative to the insulating body, wherein one of the rotating member and the pressing member has at least one crimping chamfer, the other one of the rotating member and the pressing member has at least one actuating portion, the pressing member presses the rotating member and the actuating portion slides on and along the crimping chamfer to cause the rotating member to rotate and cause the card ejecting portion to abut against and push the electronic card, and when the rotating member is in a latched state, an angle between the crimping chamfer and the longitudinal direction is between 40°~75°.

15. The card edge connector according to claim 14, wherein the at least one crimping chamfer comprises a first crimping chamfer and a second crimping chamfer, disposed with an interval therebetween, the at least one actuating portion comprises a first actuating portion and a second actuating portion, matching with the first crimping chamfer and the second crimping chamfer, respectively, and the first actuating portion slides on the first crimping chamfer before the second actuating portion slides on the second crimping chamfer.

16. The card edge connector according to claim 15, wherein the at least one crimping chamfer further comprises a third crimping chamfer, the third crimping chamfer is connected end to end with the first crimping chamfer, and when the first actuating portion slides on and along the third crimping chamfer, the second actuating portion slides on and along the second crimping chamfer correspondingly.

17. The card edge connector according to claim 16, wherein an angle between the third crimping chamfer and the longitudinal direction is greater than an angle between the first crimping chamfer and the longitudinal direction.

18. The card edge connector according to claim 15, wherein the first crimping chamfer and the second crimping chamfer are arranged on the rotating member, a slot is formed on a bottom edge of the pressing member and penetrates through the pressing member in the longitudinal direction, the first actuating portion is formed on each of two opposite sides of the slot on the bottom edge of the pressing member respectively, and the two opposite sides of the slot extend to the bottom edge of the pressing member to form a plurality of extending portions, and the second actuating portion is formed at each of ends of the extending portions respectively.

19. The card edge connector according to claim 14, wherein at least one end of the insulating body has a mounting portion having a receiving groove;

two lateral walls positioned on two opposite sides of the receiving groove; and at least one end wall, having a through slot, penetrating through the end wall along the longitudinal direction and communicated with the receiving groove and; and a connecting portion, positioned above the through slot and connected to the two lateral walls; and wherein the rotating member has a protrusion buckled to the end wall, and when the card ejecting portion completely abuts against and pushes the electronic card, the rotating member is at least partially exposed to the insulating body through the through slot.

20. The card edge connector according to claim 14, wherein at least one end of the insulating body has a mounting portion, the latch device is mounted on the mounting portion, a reinforcing rib protrudes and extends from each of two sides of the mounting portion, and a clamping slot configured to clamp a side edge of the electronic card is formed between the two reinforcing ribs.

21. The card edge connector according to claim 14, further comprising at least one power terminal, wherein the electronic card has a notch configured to latch the latch portion; and at least one power conductive sheet under the notch; and wherein when the electronic card is inserted into the central slot, the power terminal is electrically connected with the power conductive sheet.

22. The card edge connector according to claim 14, further comprising at least a pair of power terminals and two side walls arranged at one end of the central slot, wherein each power terminal has a contact point, the rotating member has a card ejecting portion, and the card ejecting portion passes beyond contact points without interference along the longitudinal direction both when the rotating member is in an open state and when the rotating member is in a latched state.

* * * * *